US010913914B2

(12) United States Patent
Sadeghi et al.

(10) Patent No.: US 10,913,914 B2
(45) Date of Patent: Feb. 9, 2021

(54) LUBRICANTS COMPRISING CARBON PARTICLES AND METHODS OF MAKING THE SAME

(71) Applicant: Purdue Research Foundation, West Lafayette, IN (US)

(72) Inventors: Farshid Sadeghi, West Lafayette, IN (US); Vilas Ganpat Pol, West Lafayette, IN (US); Abdullah A. Alazemi, West Lafayette, IN (US); Vinodkumar Etacheri, Kerala (IN); Arthur D. Dysart, Baldwin, NY (US)

(73) Assignee: Purdue Research Foundation, West Lafayette, IN (US)

( * ) Notice: Subject to any disclaimer, the term of this patent is extended or adjusted under 35 U.S.C. 154(b) by 11 days.

(21) Appl. No.: 15/085,256

(22) Filed: Mar. 30, 2016

(65) Prior Publication Data

US 2016/0289586 A1 Oct. 6, 2016

Related U.S. Application Data

(60) Provisional application No. 62/140,908, filed on Mar. 31, 2015.

(51) Int. Cl.
*C10M 125/02* (2006.01)
*C10M 125/00* (2006.01)
(Continued)

(52) U.S. Cl.
CPC ..... *C10M 125/02* (2013.01); *C10M 125/00* (2013.01); *C10M 2201/041* (2013.01); *C10M 2201/065* (2013.01); *C10M 2201/066* (2013.01); *C10N 2010/02* (2013.01); *C10N 2010/08* (2013.01); *C10N 2010/12* (2013.01); *C10N 2020/06* (2013.01); *C10N 2030/06* (2013.01); *C10N 2070/00* (2013.01)

(58) Field of Classification Search
CPC ..... C10M 2201/041; C10M 2201/066; C10M 2201/065; C10N 2210/01; C10N 2210/04; C10N 2210/06; C10N 2220/082; C10N 2230/06; C10N 2270/00
See application file for complete search history.

(56) References Cited

U.S. PATENT DOCUMENTS 8,648,019 B2 2/2014 Pol et al.
2011/0287987 A1* 11/2011 Mordukhovich .... C10M 171/00 508/103
(Continued)

*Primary Examiner* — Vishal V Vasisth
(74) *Attorney, Agent, or Firm* — Hartman Global IP Law; Gary M. Hartman; Domenica N.S. Hartman

(57) ABSTRACT

A lubricant includes carbon particles in a carrier. The carbon particles may be nearly spherical, individually have maximum and minimum diameters that differ by no more than ten nanometers, and the maximum diameters of the carbon particles are less than one micrometer. The lubricant may be manufactured by preparing the carbon particles by ultrasound-assisted polymerization of resorcinol and formaldehyde in an aqueous system followed by a heat treatment in an inert or non-oxidizing atmosphere and dispersion of the carbon particles in the liquid hydrocarbon carrier to form the lubricant. Optionally, inorganic metals, alloys, or oxides are coated on the surface of the carbon particles via an additional thermolysis step.

9 Claims, 17 Drawing Sheets

(51) Int. Cl.

| | |
|---|---|
| *C10N 10/02* | (2006.01) |
| *C10N 10/08* | (2006.01) |
| *C10N 10/12* | (2006.01) |
| *C10N 20/06* | (2006.01) |
| *C10N 30/06* | (2006.01) |
| *C10N 70/00* | (2006.01) |

(56) References Cited

U.S. PATENT DOCUMENTS

2013/0079262 A1* 3/2013 Pol ..... C10M 169/04
508/116
2014/0371118 A1* 12/2014 Mosleh ..... C10M 171/06
508/129
2014/0371119 A1* 12/2014 Mosleh ..... C10M 171/06
508/129

* cited by examiner (b)

(a)

LUBRICANTS COMPRISING CARBON PARTICLES AND METHODS OF MAKING THE SAME

CROSS REFERENCE TO RELATED APPLICATIONS

This application claims the benefit of U.S. Provisional Application No. 62/140,908, filed Mar. 31, 2015, the contents of which are incorporated herein by reference.

BACKGROUND OF THE INVENTION

The present invention generally relates to mechanical system lubricants. The invention particularly relates to lubricant compositions containing particulate materials, especially particulate carbon materials suspended in a liquid carrier, methods of making the lubricant compositions and methods of using the lubricant compositions to achieve friction and wear reduction in mechanical systems.

Friction and wear between surfaces in proximity and moving relative to one another are often primary factors in energy loss and failure in mechanical systems, for example, reciprocating (piston) engines of the types commonly used in commercial and passenger vehicles. Generally, the majority of friction and wear losses occur in boundary and mixed lubrication regimes during startup/shutdown and low speed operation of such engines. In the boundary lubrication regime, the surfaces or asperities thereof generally contact each other despite the presence a lubricating fluid. In the mixed lubrication regime, a thin lubricant film, which may have an average thickness about 0.01 to about 1 μm, separates the surfaces. The tribological performances of traditional fluid lubricants increasingly do not meet the demands of new generation mechanical devices. As a result, there is continuous research for improving the tribological performance of lubricants.

Previous reports suggested that performance of fluid lubricants can be improved by adding solid particles as additives. These additives are beneficial in the boundary lubrication regime, where surface contact occurs even in the presence of the fluid lubricant. Consequently, many high-performance lubricating oils contain solid particle additives generally in sizes ranging from 1 to 50,000 nm. Several types of carbonaceous nanoparticles including fullerene, carbon nanotubes, and carbon nano-onions with particle sizes ranging from 1 to 30 nm have been tested as additives. Furthermore, inorganic materials such as $MoS_2$, $WS_2$, Cu, Au, and Ag with particle sizes ranging from 5 nm to 1 μm have been widely used as oil additives to improve tribological properties.

U.S. Pat. No. 8,648,019 B2, issued to Pol et al. on Feb. 11, 2014, describes a method of making lubricants containing carbon-based materials having diameters greater than one micrometer as anti-friction and anti-wear additives for advanced lubrication purposes. The contents of Pol et al. are incorporated herein by reference.

In spite of the good tribological behavior of current solid oil additives, there are several concerns about the complex synthetic methods used to create them, their toxicity, and their high cost. Another serious issue is performance degradation on prolonged use due to poor mechanical and chemical stability of the solid additives. For instance, inorganic fullerene nanoparticle additives have been observed as being flattened or broken into individual sheets after tribometer tests under boundary lubrication and ultra high-vacuum conditions.

In view of the above, there is an ongoing desire to develop lubricants with additives that can be readily synthesized and exhibit mechanical and chemical stability. It is further desirable to develop lubricants that may be capable of further reducing wear and friction compared to the lubricants previously described above.

BRIEF DESCRIPTION OF THE INVENTION

The present invention provides lubricants and methods of manufacturing lubricants that are capable of reducing friction and/or improving wear resistance within mechanical systems.

According to one aspect of the invention, a lubricant includes carbon particles in a liquid hydrocarbon carrier. The carbon particles are nearly spherical, individually have maximum and minimum diameters that differ by no more than ten nanometers, and the maximum diameters of the carbon particles are less than one micrometer.

According to another aspect of the invention, a method of manufacturing a lubricant includes preparing carbon particles by ultrasound-assisted polymerization of resorcinol and formaldehyde in an aqueous system, followed by heat treating the carbon particles in an inert or non-oxidizing atmosphere and then dispersing the carbon particles in a liquid hydrocarbon carrier to form the lubricant.

Technical effects of the lubricant described above preferably include the capability of reducing friction between surfaces in a mechanical system by locating the carbon particles between the surfaces, providing a rolling function between the surfaces, and thereby improving wear resistance of the surfaces while the mechanical system is operating in the boundary and mixed lubrication regimes.

Other aspects and advantages of this invention will be better appreciated from the following detailed description.

DETAILED DESCRIPTION OF THE INVENTION

Figure 1:
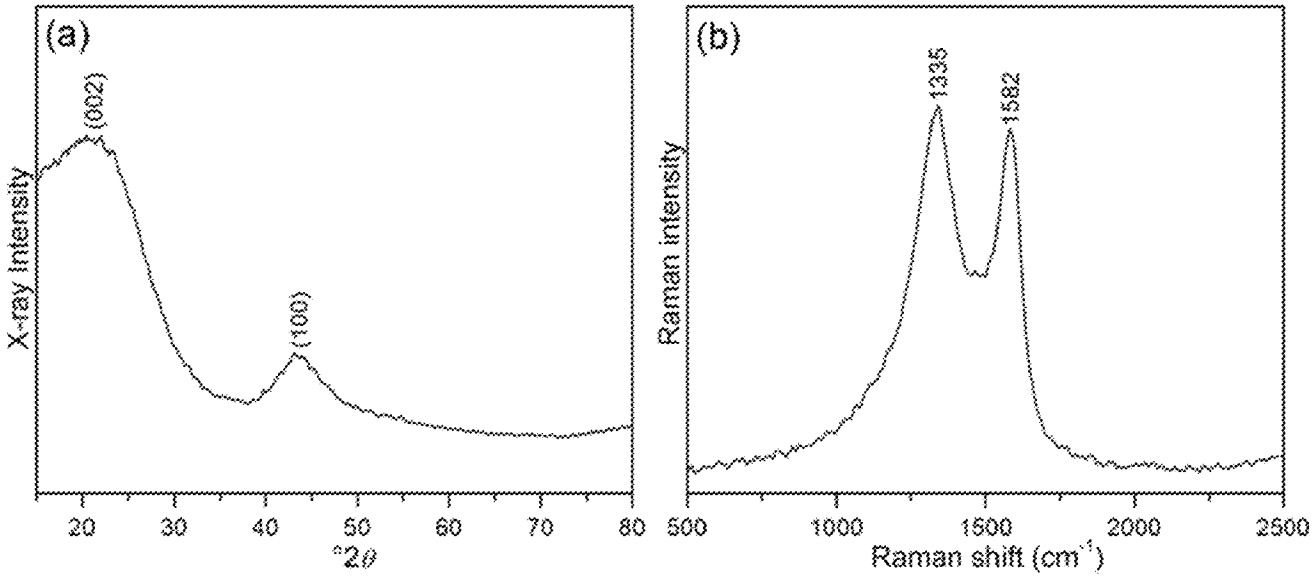
FIG. 1 includes an X-ray diffraction pattern (image (a)) and a Raman spectrum (image (b)) of ultrasmooth submicrometer carbon spheres produced in accordance with certain aspects of the invention.

The present invention generally provides additives for fluid lubricants that improve the lubricants' ability to reduce wear and friction between surfaces within a mechanical system, lubricants comprising such additives, and methods of manufacturing such lubricants and additives. In particular, the additives may include carbon particles which are preferably nearly or substantially spherical, ultrasmooth, and submicrometer in size. As used herein, nearly or substantially spherical particles refers to particles whose individual maximum and minimum diameters differ by no more than ten nanometers. Further, the terms "nearly spherical" and "spherical" are used interchangeably. The term "ultrasmooth" refers to a surface having surface irregularities (or roughness) that are on the order of a few nanometers or less, preferably no more than five nanometers. The term "submicrometer" refers to any dimension that is less than one micrometer. Therefore, a spherical ultrasmooth submicrometer carbon particle refers to a carbon particle that has all diameters within ten nanometers of one another, has surface irregularities of a few nanometers or less, and has a maximum diameter of less than one micrometer.

Spherical ultrasmooth submicrometer carbon particles (also referred to herein as carbon spheres) were synthesized by using a procedure described in the publication: Pol, V. G.; Shrestha, L. K.; Ariga, K., "Tunable, Functional Carbon Spheres Derived from Rapid Synthesis of Resorcinol-Formaldehyde Resins," ACS Appl. Mater. Interfaces 2014, 6, 10649-10655, the contents of which are incorporated herein by reference in their entirety. TEM (Transmission Electron Microscopy) images of the fabricated carbon spheres demonstrated nanometer scale surface irregularities (about 3 nm) that confirmed the ultrasmoothness of the carbon spheres, and submicrometer diameters ranging from about 0.1 to 0.5 micrometers.

Briefly, colloidal spherical polymer resins (resorcinol formaldehyde resin particles) were rapidly synthesized via enhanced copolymerization of resorcinol with a formaldehyde solution under ultrasonic irradiation, and then heat treated at a temperature sufficient to cause pyrolysis and convert the resorcinol formaldehyde resin particles to graphitic carbon. Preferably, the heat treatment is at a temperature of about 500 to 3000° C. in an inert or nitrogen atmosphere. For example, in investigations leading to the present invention, resorcinol formaldehyde resin particles were formed by mixing a 140 mL volume, 28 vol. % solution of anhydrous ethanol in an open-to-atmosphere batch reactor with type 1 water using high energy acoustic waves applied to the reactor by a piezoelectric ultrasonic probe. Prepolymers of 500 mg resorcinol and 0.7 mL aqueous formaldehyde (37 vol. %) were dissolved and dispersed, respectively, into the aqueous ethanol solution. During continuous application of ultrasonic waves, 0.4 mL of aqueous ammonium hydroxide (25 wt. %) was added evenly to the sonicated mixture across a 7 minute reaction time. The mixture temperature was maintained between 25 to 35° C. with an ice bath to prevent catalytic ammonia vaporization. Spherical submicron resorcinol formaldehyde resin particles were extracted and refined using centrifugation in type 1 water and ethanol, and finally collected after drying the precipitate at 50° C. in a vacuum. The carbon spheres were then obtained from the resorcinol formaldehyde resin particles by performing a controlled heat treatment at a temperature of 900° C. for four hours in an argon atmosphere with heating and cooling rates of about 1° C./min.

Fabrication of the submicrometer-sized particles was a challenge due to the thermodynamic and kinetic limitations of the particle formation. For example, in Pol et al., spherical particles with sizes exceeding a micrometer were fabricated with a different chemistry by heating neat, high or low density polyethylene in a sealed reactor at a temperature of at least 700° C. and under an autogenic, self generated pressure of about 600 to 2000 psi, and subsequently cooling the reactor to less than 100° C. During the cooling phase, hydrogen gas and carbon liquid resulted in particles with sizes of several micrometers, evidencing a lack of nucleation control. In contrast, methods reported herein provided for relatively strong nucleation control allowing for fabrication of submicrometer-sized particles.

As noted above, methods reported herein are capable of forming ultrasmooth submicrometer carbon spheres by ultrasound-induced polymerization of resorcinol and formaldehyde. Sonochemical synthesis causes a continuous generation and collapse of bubbles, that can excite water molecules and dissociate into H. and OH. radicals. These radicals are known for accelerating reaction rates, initiating polymerization reactions, and shortening of gelation time. Though resorcinol formaldehyde (RF) resins have been synthesized (24-hour reaction under similar experimental conditions) without ultrasonic irradiation, a high degree of agglomeration and loss of spherical morphology was observed. Therefore, the rapid polymerization and nearly spherical morphology provided with the methods described herein were attributed to the sonochemical effects. This method of carbon sphere synthesis is relatively inexpensive, relatively simple, and can be easily scaled up for commercial applications.

Various tests were performed to determine the structure and properties of carbon spheres produced by ultrasound-induced polymerization of resorcinol and formaldehyde. X-ray diffraction (XRD) patterns of the carbon spheres ($2\theta$=15–80°) were recorded with a Rigaku Smartlab X-ray diffractometer operated at 40 kV and 40 mA using Cu-K$\alpha$ radiation ($\lambda$=0.154184 nm) at 25° C. with a 20 step size of 0.02 and a scanning speed of 2°/min. A Thermo Scientific DXR Raman spectrometer equipped with a 532 nm laser was used for recording the Raman spectra of carbon sphere samples. Laser power was limited to 8 mW to avoid sample burning. Scanning electron microscopy (SEM) images were recorded using a Hitachi S-4800 microscope operating at an acceleration voltage of 25 kV. Transmission electron microscopy (TEM) measurements were carried out using an FEI-TITAN microscope operating at an accelerating voltage of 300 kV.

Image (a) of FIG. 1 shows an XRD pattern of the carbon spheres after heat treatment at 900° C. The carbon spheres exhibited broad peaks centered at about 21 and 43.8° 20, which are characteristic of (002) and (100) graphitic planes of carbon. Image (b) of FIG. 1 shows a Raman spectra of the carbon spheres with distinct D and G peaks at 1335 and 1582 $cm^{-1}$, respectively. These bands correspond to the disordered carbon/structural defects and graphitic layers (sp2 bonded carbon atoms) of the carbon spheres, respectively. Increased D-band intensity compared to G-band (ID/IG=1.07) confirmed the disordered nature of the carbon spheres (Image (b)). This indicated that the heat treated resorcinol formaldehyde (RF) based resins produced an amorphous carbon at 900° C. At higher temperatures, an increase in graphitic order is expected. The area under the D and G peaks confirmed around 60% (sp3) and around 40% (sp2) type carbons were present in the carbon spheres.

Figure 2:
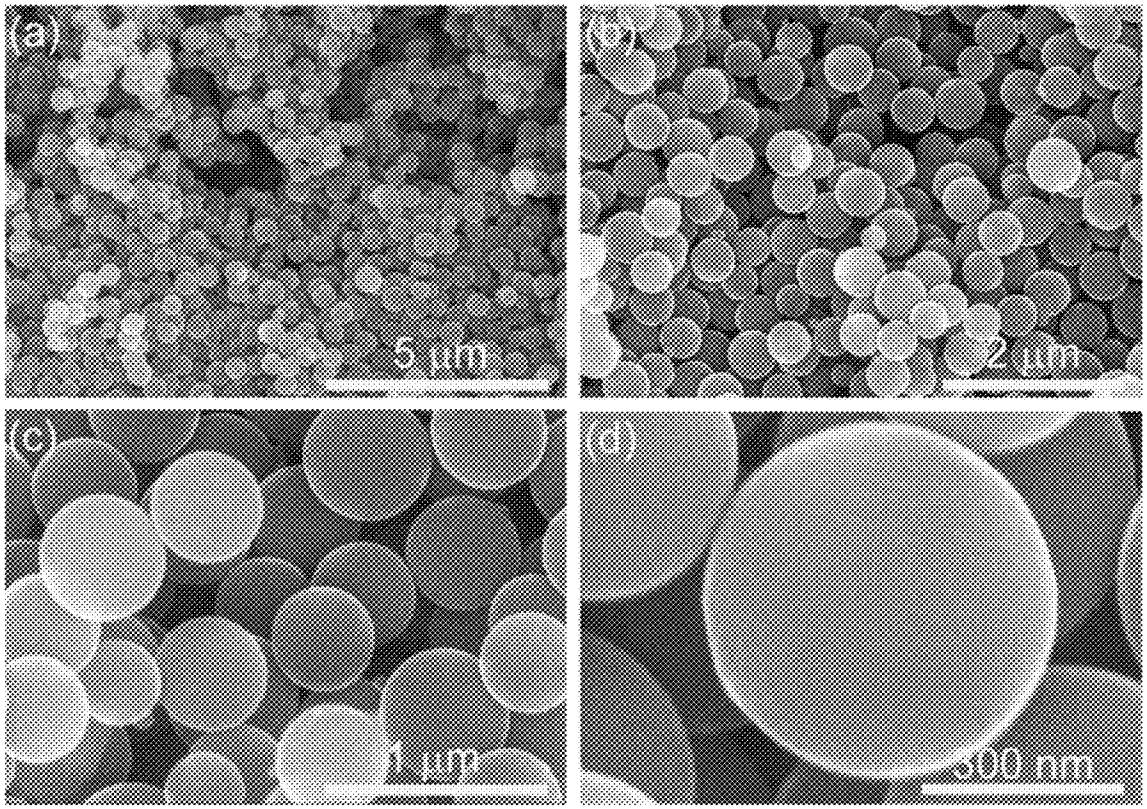
FIG. 2 shows SEM (Scanning Electron Microscopy) images of ultrasmooth carbon submicrometer spheres produced in accordance with certain aspects of the invention at various magnifications.

Scanning electron microscopy (SEM) images of the carbon spheres at various magnifications are presented in FIG. 2. The carbon spheres were observed to have average diameters of about 100-500 nm, and individual spheres were well separated from each other with little or no agglomeration. Moreover, the higher-resolution images show the particles to be nearly spherical. Consequently, the carbon spheres had a spherical morphology and a high-degree of surface smoothness, which are highly beneficial for the tribological performance of lubricants. In general, spherical particles are highly desirable compared to other morphologies as lubrication additives. In particular, spherical particles can roll or slide between surfaces of a mechanical system in an oil, reducing the friction and wear between the surfaces. Other morphologies such as rods, tubes, and sheets may not be capable of such rotation and/or sliding behavior and could have adverse effects as lubrication additives or potentially even increase wear within the system.

Figure 3:
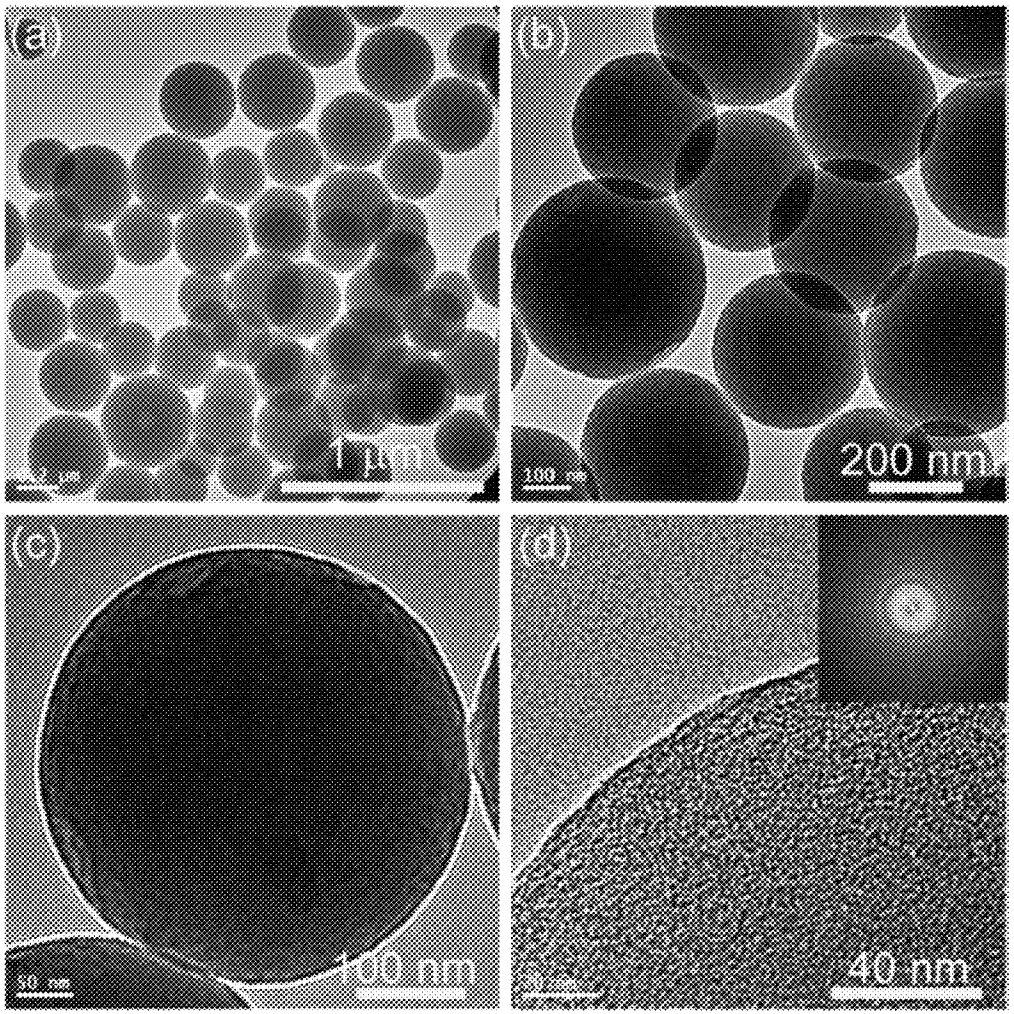
FIG. 3 shows in images (a), (b), (c), and (d) TEM (Transmission Electron Microscopy) images of ultrasmooth carbon submicrometer spheres produced in accordance with certain aspects of the invention at various magnifications. An inset in image (d) shows a diffraction pattern.

Morphology and microstructure of the carbon spheres were further investigated using high-resolution transmission electron microscopy (HR-TEM). Images (a), (b), (c), and (d) of FIG. 3 show the nearly spherical shape and nanometer level surface smoothness of the 100-500 nm sized carbon spheres. Disordered graphitic planes and diffused selected area electron diffraction (SAED) patterns (inset of image (d) in FIG. 3) are in agreement with the XRD and Raman results discussed previously, confirming the disordered microstructure of the carbon spheres. Image (d) of FIG. 3 also demonstrated the nanometer scale (about 3 nm) surface irregularities that confirmed the ultrasmoothness of the carbon spheres.

Figure 4:
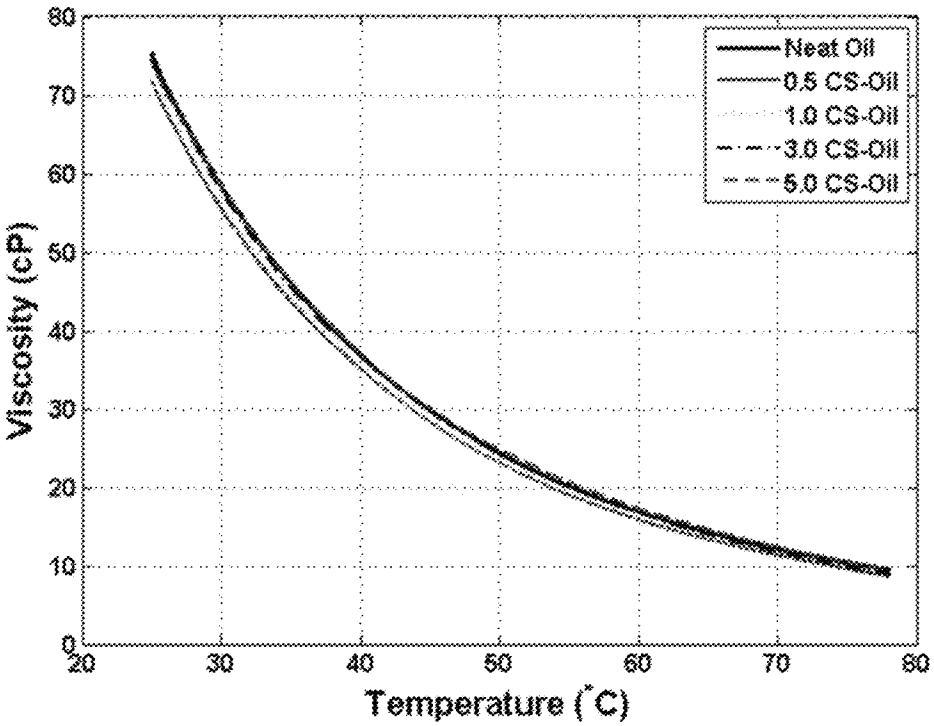
FIG. 4 is a representation of the viscosity-temperature relationship of neat oil and oils with 0.5 to 5 wt. % ultrasmooth carbon submicrometer spheres therein (error in viscosity measurement is ±2%).

Performance of the carbon spheres within fluid lubricants was analyzed by performing various tests which compared a reference oil lubricant to samples of the same reference oil lubricant comprising carbon spheres suspended therein that were formed by ultrasound-induced polymerization of resorcinol and formaldehyde as described above. Since the majority of friction and wear losses generally occur in the boundary and mixed lubrication regimes during engine transient operation, SAE (Society of Automotive Engineers) Designation 5W30 engine oil (Valvoline, USA) was used as the reference oil lubricant. As used herein, "neat oil" refers to the reference oil lubricant containing no additives. The kinematic viscosity of the neat oil was 63 $mm^2/s$ at 40° C. and 11 $mm^2/s$ at 100° C., and its density was 861 $kg/m^3$ at 15° C. For comparison, the carbon spheres were ultrasonically dispersed (10-20 s) with a sonochemical tip irradiation under 20% power in the reference lubricant at concentrations of about 0.5, 1, 3, and 5 wt. % to produce samples identified herein as 0.5 CS-Oil, 1.0 CS-Oil, 3.0 CS-Oil, and 5.0 CS-Oil, respectively (collectively referred to as CS samples). The ultrasound mediated technique allowed the carbon spheres to be suspended in the hybrid lubricant for a substantial period of time (about 2-3 weeks) without using any surfactant. Viscosity measurements of the neat oil and CS samples were conducted using a tuning fork-type vibrating viscometer with accuracy of ±1% of the measured quantity. Each sample was heated above 75° C., and viscosity was measured as it cooled to ambient temperature. FIG. 4 plots viscosity as a function of temperature for the neat oil and CS samples. Viscosity measurements of the neat oil and CS samples showed that the change in the viscosity of the neat oil was less than 5% with the addition of the carbon sphere additives.

Tribology experiments were conducted at room temperature using three different test systems: (1) a pin-on-disk (POD) apparatus, which operates at high contact pressure and low rotational speeds to investigate tribology performance in the boundary lubrication regime; (2) a cylinder-on-disk (COD) tribometer that operates at low contact pressure and high rotational speed to examine the lubrication performance in the mixed lubrication regime; and (3) a glass disk test rig (GDTR) to observe the lubricant flow, friction force, and fluid film thickness during sliding motion. These test systems are well known to those skilled in the art. The arithmetic average (Ra) surface roughness of the specimens was measured using an optical surface profilometer. Friction and wear studies using the pin-on-disk apparatus were performed under the rotational motion of a disk with a stationary pin. A 12.7 mm diameter stainless steel ball with an Ra surface roughness of 15 nm is used as the stationary pin specimen while a TiCN coated steel disk with an Ra surface roughness of 32 nm was rotating with a speed controlled by a DC servo motor. In the cylinder-on-disk tribometer (Bruker UMT-2), friction tests were conducted under the rotational motion of a disk with a stationary cylinder. The Ra surface roughness was 110 nm for the cylinder and 20 nm for the disk. A 10 mm diameter steel cylinder with a 12.7 mm length and a 70 mm diameter stainless steel disk were used in the cylinder-on-disk tribometer. In the glass disk test rig, a stationary stainless steel specimen was in contact with a rotating glass disk. The glass disk was driven by an AC motor while an infrared tachometer was used to measure the rotational speed of the glass disk. The Ra surface roughness was 120 nm for the stainless steel specimen. Tribology experiments were repeated at least three times, and the measured friction and wear values were within a 5% error limit.

Tribological performance of the carbon spheres as fluid lubricant additives in the boundary lubrication regime was investigated using the pin-on-disk (POD) apparatus. The effect of carbon sphere concentrations in oil ranging from 0.5 to 5 wt % was observed under 22.2 N of applied normal load (corresponding to 1 GPa maximum Hertzian pressure) and variable sliding speed. The sliding speed was increased every 20 minutes by 0.1 m/s step from 0.1 to 0.3 m/s. On the basis of POD test conditions, material parameters, and surface roughness measurements, the lambda ratio (A) was equal to 0.2, which confirmed that the contact conditions were within the boundary lubrication regime.

Figure 5:
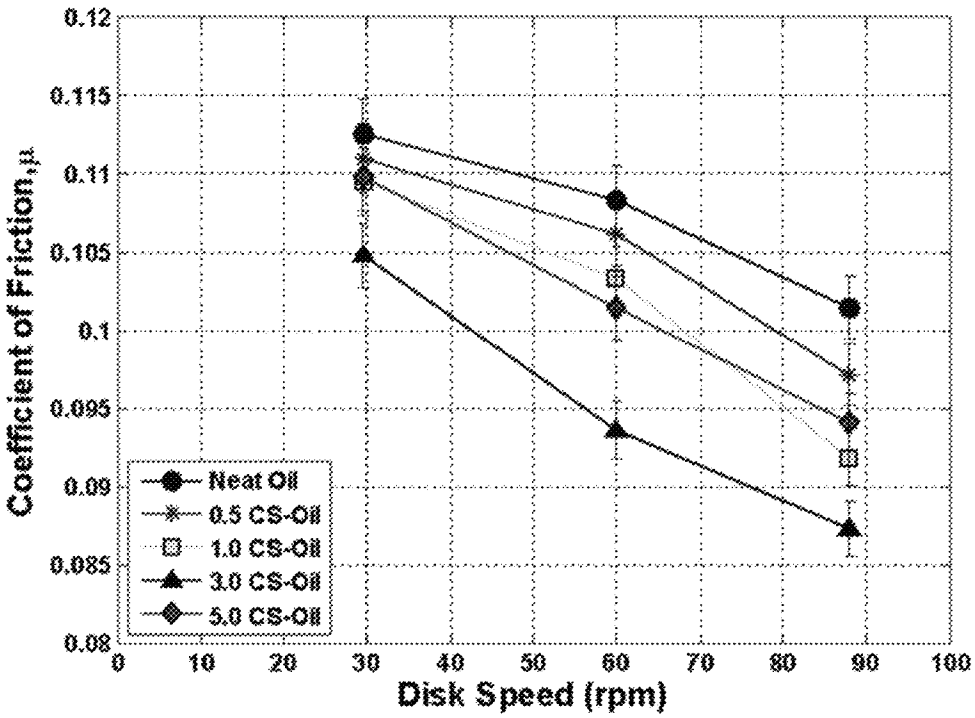
FIG. 5 is a representation of a coefficient of friction for different weight percent concentrations of ultrasmooth carbon submicrometer spheres in oil under a 22.2 N normal load (1.0 GPa maximum Hertzian pressure) using a POD apparatus versus disk speed (error in coefficient of measurement is ±5%).

The carbon sphere additives reduced the coefficient of friction relative to the neat oil for all carbon sphere loading and sliding speeds. The lubricant containing 3 wt. % carbon spheres (3.0 CS-Oil) exhibited the lowest coefficient of friction relative to the lower and higher carbon sphere concentrations and the neat oil. This can be explained in that when two surfaces come into contact by an applied force, the actual contact area is significantly less than the apparent area of contact because of surface roughness, that is, only asperities of the two surfaces physically contact each other. The gap between surfaces in contact can be filled with the carbon spheres. However, after a certain concentration the contact area is saturated with carbon spheres and any more carbon spheres will not be beneficial. In this instance, it was concluded that the 3.0 CS-Oil represented the point at which the lubricant was saturated with carbon spheres and the surface contact areas could not contain more solid additives. The coefficient of friction (COF) was found to be 0.103 and 0.087 for the neat oil and 3.0 CS-Oil, respectively, at a sliding speed of 0.3 m/s. FIG. 5 shows that the coefficient of friction decreased with increasing disk rotating speed. Furthermore, the friction reduction percentage increased with disk rotating speed. At sliding speeds of 0.045 and 0.3 m/s, the 3.0 CS-Oil demonstrated a friction reduction of 7% and 16%, respectively, compared to the neat oil.

Figure 6:
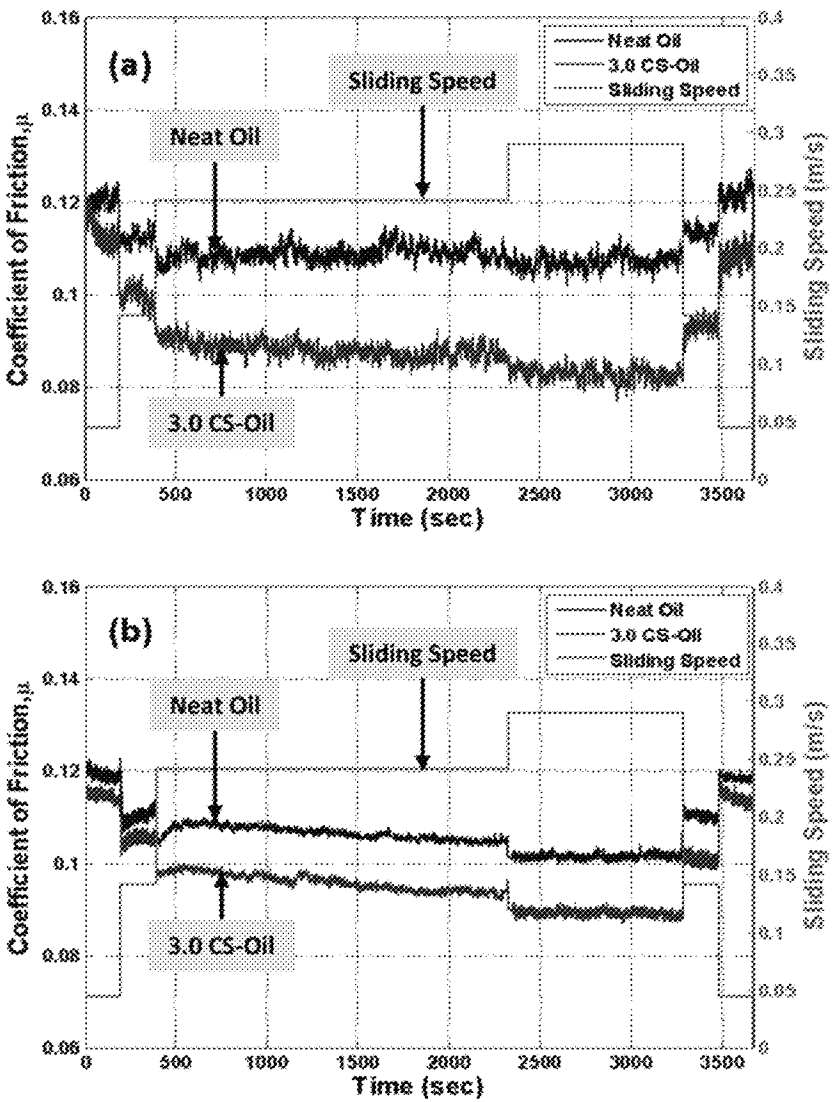
FIG. 6 is a representation of coefficient of friction and sliding speed versus time for neat oil and 3.0 CS-Oil using a POD apparatus under (image (a)) a 22.2 and (image (b)) a 93.7 N applied normal load (error in coefficient of measurement is ±5%).

The tribological behavior of the 3.0 CS-Oil was further investigated at two different applied normal forces of 22.2 and 93.7 N (corresponding to maximum Hertzian contact pressures of 1.0 and 1.7 GPa, respectively) as shown in FIG. 6. The sliding speed varied from 0.045 to 0.290 m/s in a one-hour performance test of the 3.0 CS-Oil. With an increase in sliding speed, a lowering COF was identified for both the neat oil and the 3.0 CS-Oil under two different Hertzian pressures. Under 1.0 GPa Hertzian pressure, the 3.0 CS-Oil produced an average friction reduction of 18% at various sliding speeds. However, the 3.0 CS-Oil exhibited a lower friction reduction of 10% at various sliding speeds under a higher Hertzian pressure of 1.7 GPa. This reduced lubrication performance under high contact pressure can be explained by gap diminution due to surface deformation in the area of contact that impedes carbon sphere flow between contact surfaces. Table 1 summarizes the wear scar diameter and wear volume of the test specimen measured using an optical surface profilometer (using ASTM standards) after each test.

TABLE 1

Wear Scar Diameter and Wear Volume Loss Measurements for the Neat Oil and 3.0 CS-Oil under 1.0 and 1.7 GPa Maximum Hertzian Pressure on the Pin-on-Disk Apparatus (Error ± 5%)

| Maximum Hertzian Pressure, Pmax (GPa) | Lubricant Type | Wear Scar Diameter (μm) | Wear Volume Loss ($mm^3$) |
|---|---|---|---|
| 1.0 | Neat oil | 490 | $0.45 \times 10^{-3}$ |
| 1.7 | Neat oil | 610 | $1.07 \times 10^{-3}$ |
| 1.0 | 3.0 CS-Oil | 370 | $0.15 \times 10^{-3}$ |
| 1.7 | 3.0 CS-Oil | 545 | $0.68 \times 10^{-3}$ |

Figure 7:
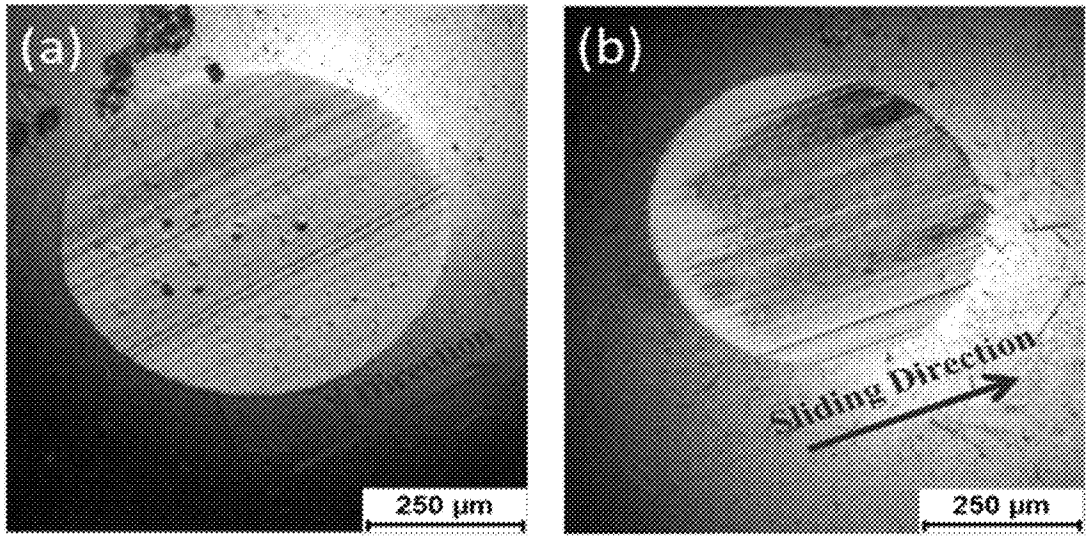
FIG. 7 shows wear scar optical micrographs on ball specimen under a 93.7 N applied normal load using a POD apparatus for (image (a)) neat oil and (image (b)) 3.0 CS-Oil lubrication.

The 3.0 CS-Oil reduced the wear scar diameter by 25% and wear volume loss by 66% under 1.0 GPa Hertzian contact pressure relative to the neat oil. Under the higher contact pressure of 1.7 GPa, the 3.0 CS-Oil exhibited 10% wear scar diameter and 36% wear volume loss reduction. Optical micrographs of the tested ball specimen under 1.7 GPa Hertzian pressure with the neat oil (image (a)) and 3.0 CS-Oil (image (b)) are presented in FIG. 7. Unlike the neat oil, the hybrid composition 3.0 CS-Oil was able to react with the contact area on the ball to form a protective dark film that led to friction and wear reduction.

Figure 8:
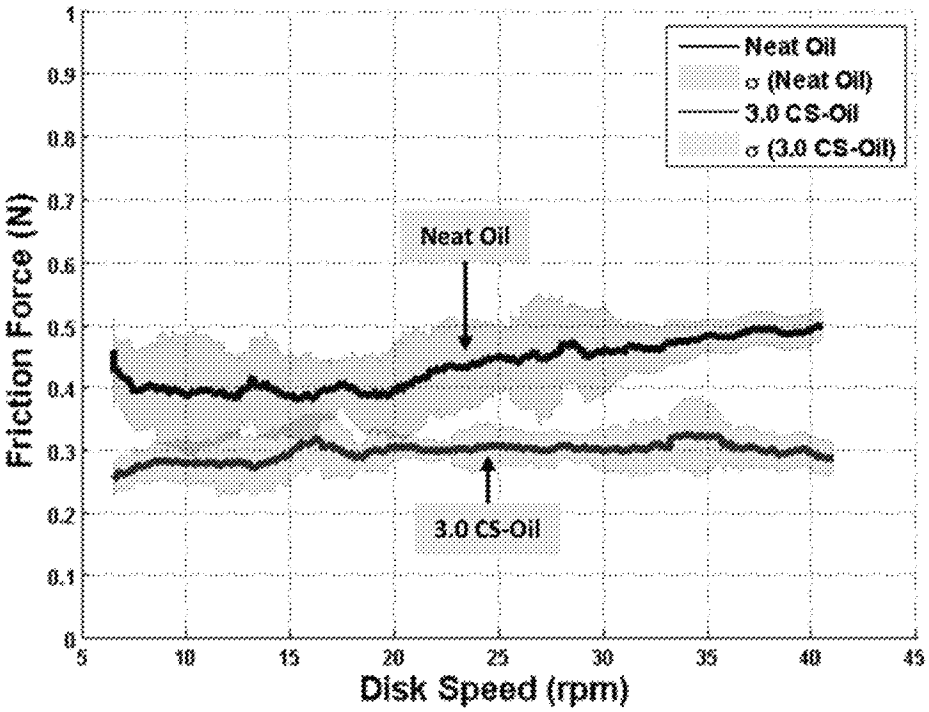
FIG. 8 is a representation of friction force versus glass disk rotational speed under a 1.5 N applied load in a glass disk test rig (GDTR) for a contact lubricated by neat oil and 3.0 CS-Oil.
Figure 9:
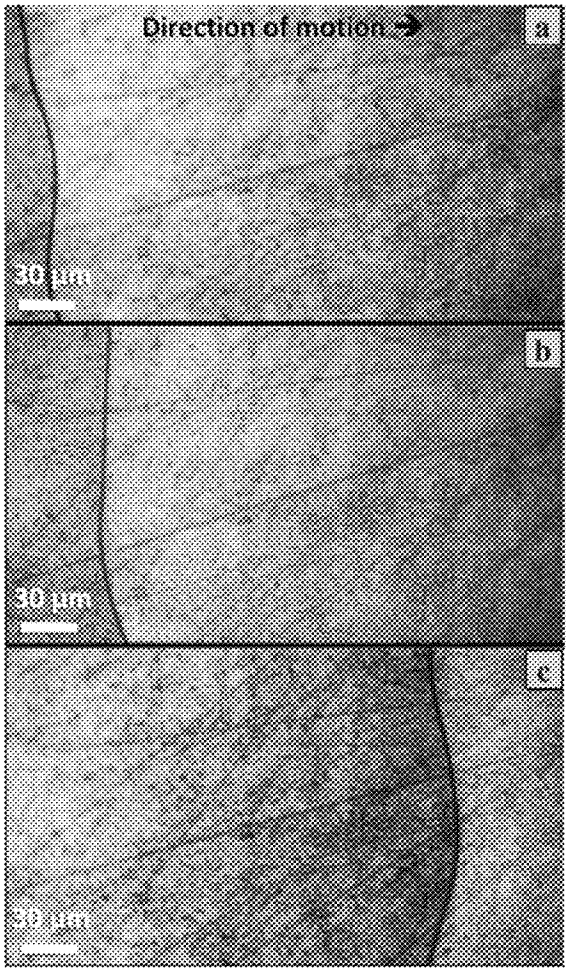
FIG. 9 shows optical micrographs of the 3.0 CS-Oil flow in a glass disk test rig under a 1.5 N applied load.

In order to further investigate the lubrication mechanism of the hybrid lubricant, the glass disk test rig was used to visualize the lubricant flow and measure friction force and fluid film thickness during sliding motion. FIG. 8 depicts the results obtained under a 1.5 N applied load and disk rotational speeds of 6 to 40 rpm. The shaded area represents the standard deviation (a) of the experimental data while the solid line represents the average friction force. The 3.0 CS-Oil exhibited a friction reduction of 5 to 30% relative to the neat oil. This observation supported the results obtained from POD apparatus. The glass disk test rig further confirmed the homogeneity of the 3.0 CS-Oil during sliding motion under a 1.5 N applied load, as shown in FIG. 9. The vertical black line and the dark area to the left of the line represents the lubricant mixture which is shown as flowing (left to right) on the specimen in images (a) through (c). The film thickness measurements did not show any difference between the neat oil and the 3.0 CS-Oil during surfaces sliding. Since the specimen had a 120 nm Ra surface roughness, it was concluded that carbon spheres with diameters of 100 to 500 nm can act as third-body particles filling the gap between surface asperities without significantly changing the lubricant film thickness. In addition, the presence of the carbon spheres between the surfaces in the boundary and mixed lubrication regimes may result in a rolling motion where the carbon spheres may act as nanoscale ball bearings.

Figure 10:
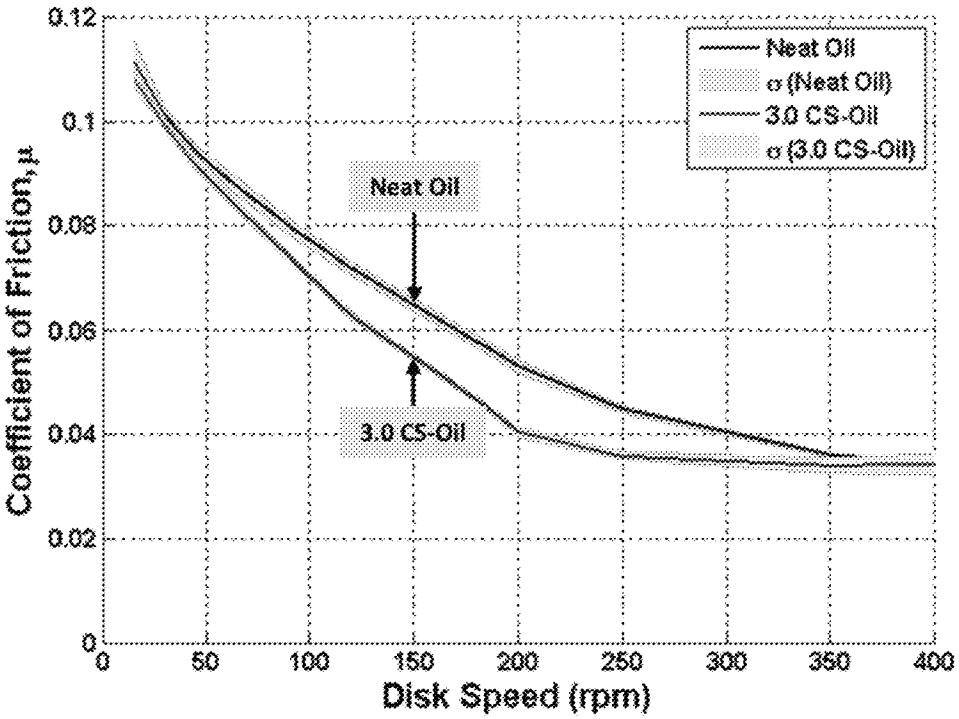
FIG. 10 is a plot of coefficient of friction versus disk rotational speed under a 50 N applied load in a cylinder-on-disk tribometer for a contact lubricated by neat oil and 3.0 CS-Oil.

Tribological performance of the carbon sphere oil mixture in the mixed lubrication regime where surfaces are separated by a thin lubricant film (less than 1 μm and greater than 0.01 μm) was investigated using the cylinder-on-disk (COD) tribometer. Results obtained under 50 N normal load and various rotational speeds (15 to 400 rpm) is presented in FIG. 10. The shaded area represents the standard deviation (σ) of the experimental data while the solid line represents the average coefficient of friction. A noticeable and rapid decrease in coefficient of friction values was observed with increasing disk rotational speed for both the neat and hybrid oils. This rapid decrease with an increase in disk rotational speed confirms that the system was working in the mixed lubrication regime until the coefficient of friction reached a lower plateau corresponding to the beginning of the hydrodynamic lubrication regime. For the COD tribometer test conditions, material parameters, and surface roughness measurements, the lambda ratio ($\lambda$) was equal to 0.2 at a disk rotational speed of 15 rpm while $\lambda$ was equal to 2.1 at a disk rotational speed of 400 rpm. This confirmed that the contact conditions started within the boundary lubrication regime and then reached the mixed lubrication regime. The 3.0 CS-Oil displayed a friction reduction of 5 to 23% compared to the neat oil. A maximum friction reduction of 23% was achieved at a disk speed of 200 rpm, which was about the middle of the mixed lubrication regime. The lubricant film thickness increased from 0.01 to 1 μm in the mixed lubrication regime with an increase of the rotational speed of the disk. This explained the superior friction reduction observed at increased disk speeds for the hybrid lubricant compared to the neat oil. In particular, as the lubricant film thickness increased, more of the carbon spheres were permitted to flow between the contacting surfaces. Once the film thickness was greater than the diameter of the carbon spheres (about 300 nm), then the role of the carbon spheres diminished and the lubricant mixture performed similar to the neat oil as seen at higher speeds (FIG. 10).

Figure 11:
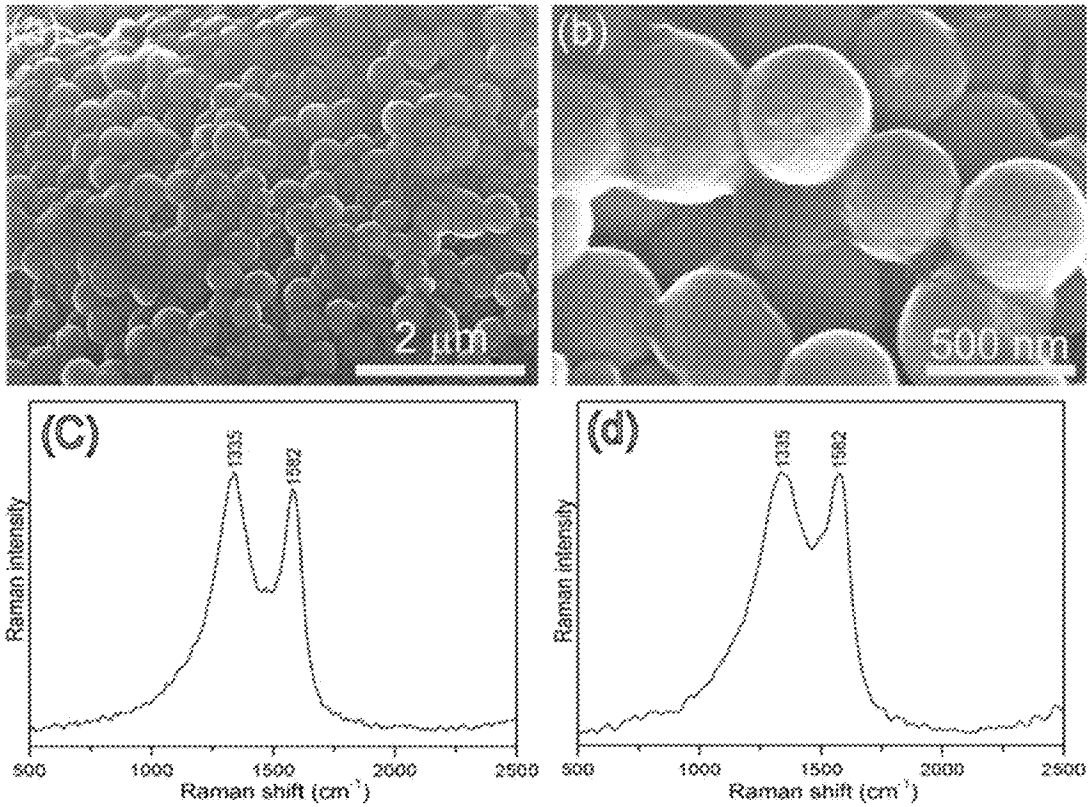
FIG. 11 includes SEM images of ultrasmooth carbon submicrometer spheres after a one-hour tribometer test on the pin-on-disk apparatus (images (a) and (b)), and Raman spectra of ultrasmooth carbon submicrometer spheres before and after tribological measurements (images (c) and (d), respectively).

In order to assess the mechanical and chemical stability of the carbon spheres, scanning electron microscopy and Raman spectroscopy analysis were performed for carbon spheres collected after a one-hour test under a 22.2 N applied load on the POD apparatus. Interestingly, the carbon spheres maintained their spherical morphology as shown in images (a) and (b) of FIG. 11, the only noticeable difference being the appearance of a thin layer of oil on their surfaces. It was concluded to be remarkable that the carbon spheres maintained their spherical shape even after going under the extreme boundary lubrication conditions on the POD apparatus. Isoenergetic D and G bands (at 1335 and 1582 $cm^{-1}$, respectively) of the carbon spheres before and after the POD test, as shown in images (c) and (d) of FIG. 11, explained their chemical stability. Morphology preservation of the carbon spheres under extreme boundary lubrication conditions also supported the theory of their rolling motion during tribological measurements. As mentioned previously, mechanical and chemical stability are very crucial for lubricant additives. The significantly improved tribological performance of the hybrid lubricant can be explained by the carbon spheres acting as a third-body material filling the gap between surface asperities, increasing actual contact area, and reducing contact pressure. Consequently, their mechanical and chemical stability further evidenced that carbon spheres as described herein should be a desirable lubricant additive.

In view of the above investigations, ultrasmooth submicrometer carbon spheres were illustrated as effective additives in fluid lubricates. An ultrasound-assisted method was used for the rapid synthesis of these nearly spherical and ultrasmooth carbon spheres with diameters ranging from 10 to 999 nm. Tribological tests demonstrated a significant reduction in friction and wear (10-25%) by adding 3 wt. % of carbon spheres to a reference oil. Friction reduction was dependent on the sliding speed and applied load, and maximum reduction was achieved at the highest sliding speed in the boundary lubrication regime. Excellent mechanical and chemical stability of the carbon spheres were evidenced by their microscopic and spectroscopic investigation before and after the tribological experiments. The notably improved tribological performance of the hybrid lubricant was explained by the nearly spherical shape and ultrasmooth nature of the carbon spheres. While operating in the boundary and mixed lubrication regimes, ultrasmooth carbon spheres may cause rolling motion where the system may act as ball bearings on the nanometer scale. These investigations evidenced that carbon spheres have potential to improve the tribological performance of current generation oil lubricants.

While the above description focuses on carbon spheres as additives to liquid lubricants, such particles can also be added to highly viscous lubricants such as greases used in lubrication of ball bearings and many other applications found in a variety of machinery. In some situations, flowing liquid lubricants are not appropriate such as in bearings and gears, where greases are generally employed. It is within the scope of the invention that such greases can employ the carbon spheres as additives to the lubricant.

Furthermore, the carbon spheres can be in-situ decorated (coated) with inorganic fullerenes. Non-limiting examples of materials that can be used to decorate the spherical particles include molybdenum disulfide ($MoS_2$), tungsten disulfide ($WS_2$), copper disulfide ($CuS_2$), and tin disulfide ($SnS_2$) nanoparticles. The carbon spheres can also be decorated with transition metals, their oxides, and P-block elements providing reduced friction coefficient and wear. The dispersion of inorganic additives (carbon spheres, $MoS_2$, $WS_2$, and their combinations, etc.) may be carried out either under sonication or in the presence of other surfactants. Dispersion of the carbon spheres and their hybrids may be adjusted by using a mixture of lubricates with slightly different viscosities. These decorations may further enhance the friction reduction and wear reduction of the lubricants. A nonlimiting example of a suitable method for decorating submicrometer-sized particles includes dispersing resorcinol formaldehyde resin particles into a chemical precursor (e.g., acetates, nitrates, ammonium cation, etc.), isolating coated resin particles therefrom, and then performing a heat treatment at a temperature of about 500-1000° C. to produce, carbon spheres having surfaces coated with inorganic materials to yield hybrid lubrication additives with attractive lubrication properties. Preferably, depending on the inorganic additive used, the maximum heat treatment temperature is sufficiently low so as to avoid melting or boiling of the inorganic materials, or so as to avoid or reduce the likelihood of the formation of undesirable materials such as alloys of the inorganic materials.

Figure 12:
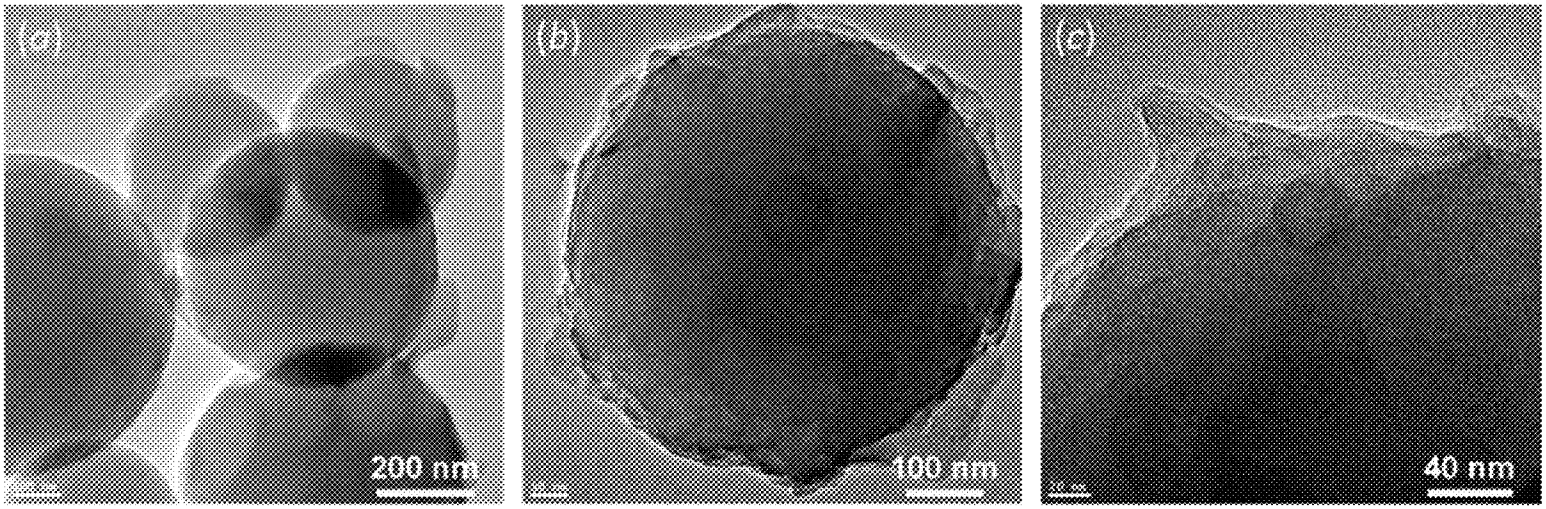
FIG. 12 includes TEM images of submicrometer carbon spheres coated with an $MoS_2$ nanolayer at various magnifications.

FIG. 12 represents TEM images of carbon sphere-$MoS_2$ particles obtained from submicrometer resorcinol-formaldehyde polymer spheres. Resorcinol-formaldehyde polymer spheres were fabricated by ultrasound assisted polymerization as described previously, followed by deposition of a molybdenum disulfide nanolayer thereon, and the aforementioned heat treatment process thereafter. In particular, the deposition of a molybdenum disulfide precursor was performed using a solution synthesis technique. In an open-to-atmosphere vessel, 0.6 g of ammonium tetrathiomolybdate was dissolved in 100 mL of dimethylformamide. Upon complete dissolution of this molybdenum disulfide precursor, 1.0 g of resorcinol-formaldehyde polymer spheres were gently dispersed in the solution using a low-energy sonication bath. The resulting mixture was then maintained at a temperature of 170° C. while continuously stirred with a magnetic stir bar. Upon drying, the solvent-free product was collected and homogenized using an agate mortar and pestle.

The product was then reduced to a final product, that is, submicrometer carbon spheres coated with molybdenum disulfide, through a thermal decomposition process. The collected composite was loaded into aluminum oxide rectangular crucibles and placed within a horizontal quartz tube furnace under continuous argon gas flow (99.999%). The heating chamber was allowed to purge for 20 minutes prior to heating. The furnace was heated at a uniform temperature rate of 10° C. /min to a dwell temperature of 600° C. for 2 hours. After cooling to room temperature, the final product was gently pulverized using a mortar and pestle.

Figure 13:
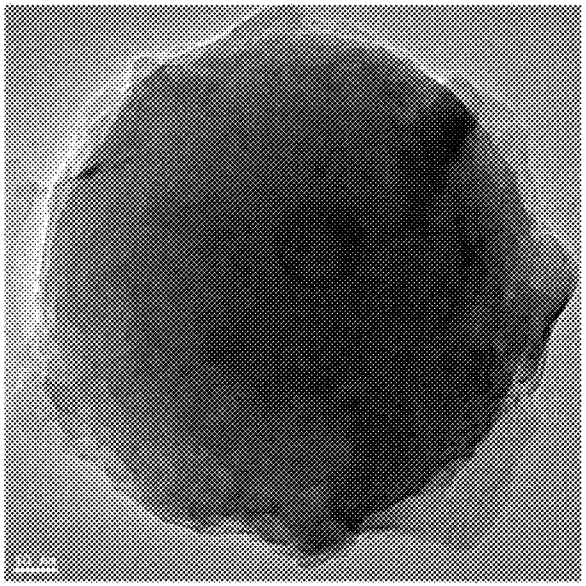
FIG. 13 includes TEM images of (image (a)) an uncoated submicrometer carbon sphere and (image (b)) a submicrometer carbon sphere coated with an $MoS_2$ nanolayer.
Figure 13:
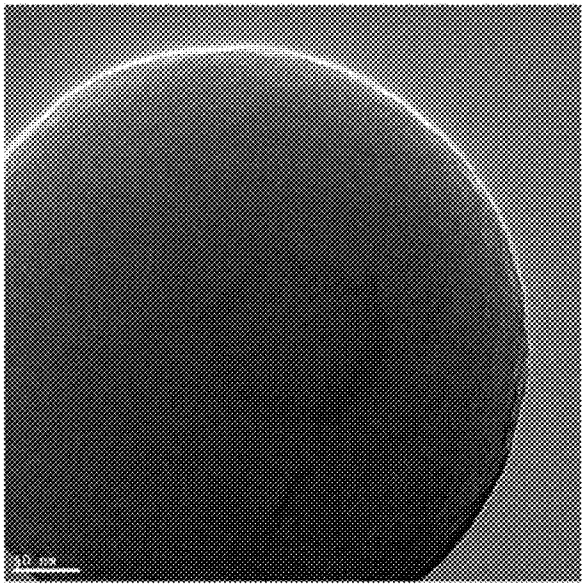
Figure 14:
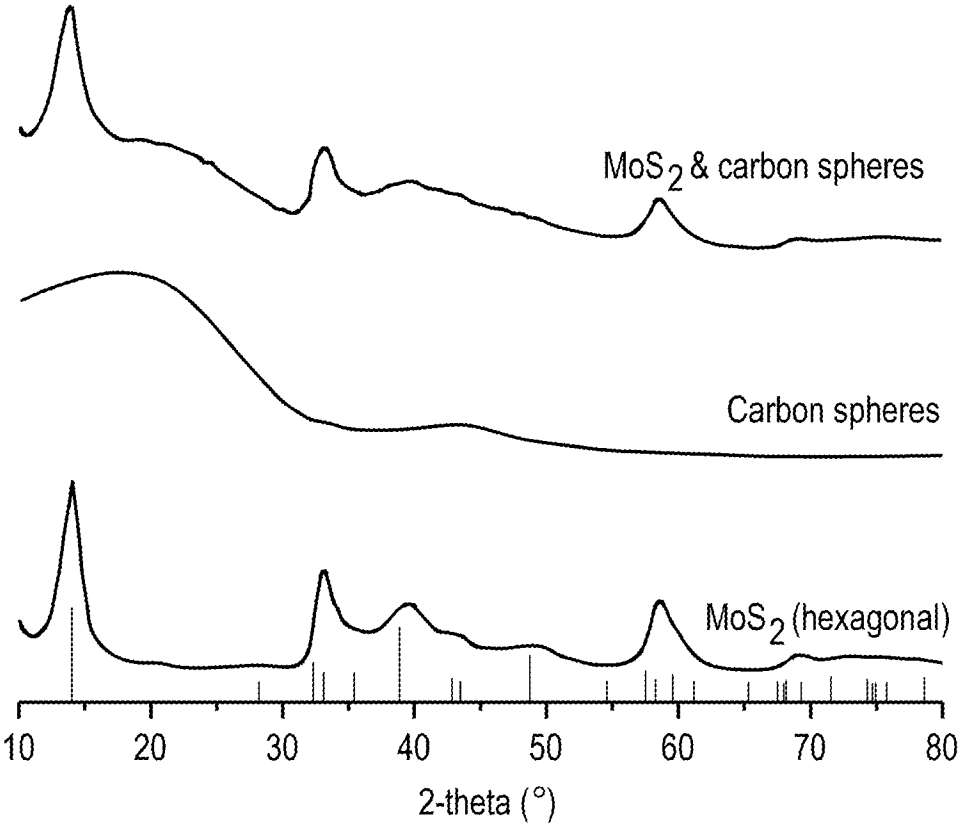
FIG. 14 is a plot of an x-ray diffraction pattern of carbon spheres alone, $MoS_2$ alone, and carbon spheres with $MoS_2$ coated thereon. All spectra were produced for this experiment from materials synthesized at a pyrolysis temperature of 600° C. for 2 hours. The characteristic spectral lines of hexagonal $MoS_2$ (drop lines) are produced from Crystallography Open Database (COD) reference 1011286 (Hassel, O. Ueber die Kristallstruktur des Molybdaenglanzes. Zeitschrift fuer Kristallographie, Kristallgeometrie, Kristallphysik, Kristallchemie (-144, 1977), 1925, 61, 92-99).

TEM images comparing carbon spheres and the carbon sphere-$MoS_2$ particles are represented in FIG. 13. As represented, the carbon sphere-$MoS_2$ particles differ from the uncoated carbon spheres due to the appearance of an irregular coating that surrounds an interior bulk phase. FIGS. 12(*a*), (*b*), and (*c*) and FIG. 13(*b*) each show carbon sphere-$MoS_2$ particles comprising irregular coatings with protrusions that protrude from adjacent surfaces of their irregular coatings. Selected area electron diffraction (SAED) of these two phases (the carbon spheres and their irregular coatings) indicate that the bulk particle phase is composed of disordered carbon, while the outer layered phase is composed of molybdenum disulfide. FIG. 14 represents the x-ray diffraction patterns of carbon spheres alone, $MoS_2$ alone, and carbon spheres with $MoS_2$ thereon. The x-ray spectral pattern for the composite material (top) is composed of individual contributions from both $MoS_2$ (bottom) and carbon spheres alone (middle). The pyrolytically-synthesized $MoS_2$ had a hexagonal crystal structure. All spectra were produced for this experiment from materials synthesized at a pyrolysis temperature of 600° C. for 2 hours.

Figure 15:
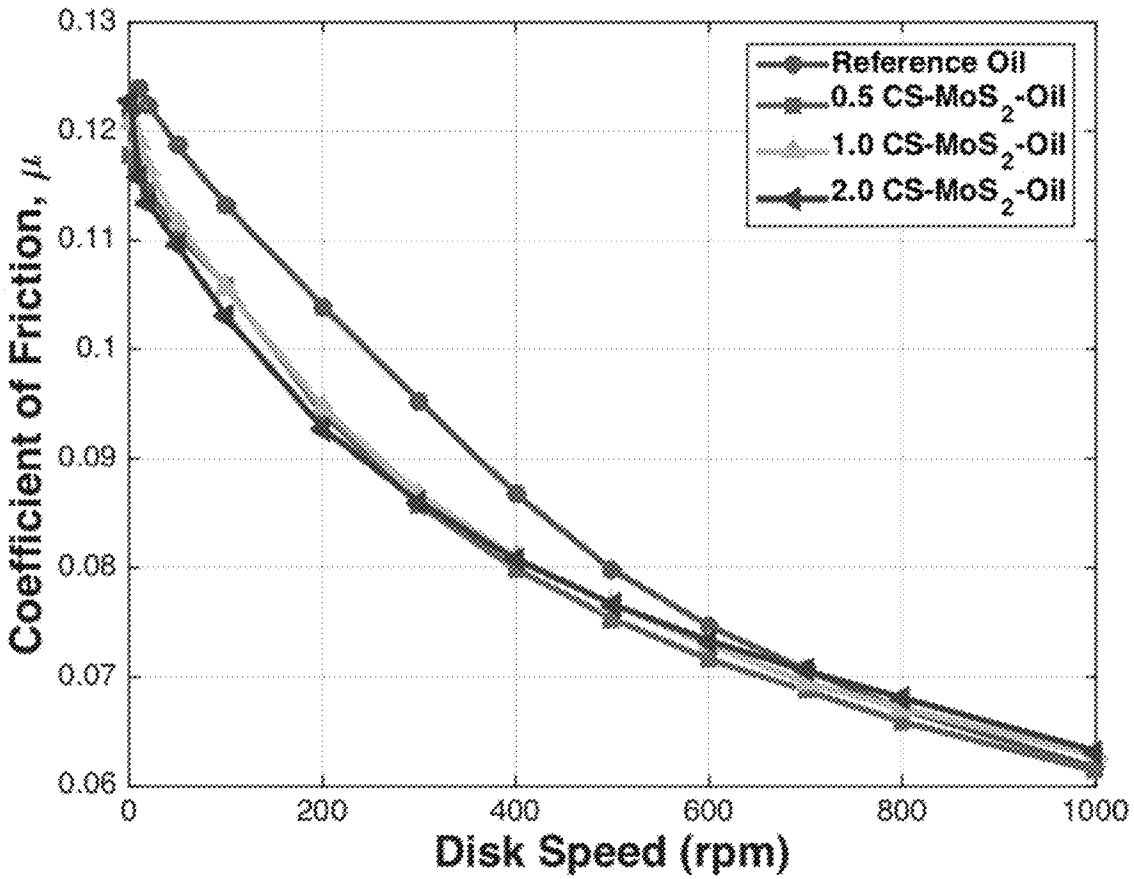
FIG. 15 is a plot of coefficient of friction versus disk rotational speed under 15 N applied load in a ball-on-disk tribometer (error ±5%) for a contact lubricated by neat oil and 0.5 CS-$MoS_2$—Oil, 1.0 CS-$MoS_2$—Oil, and 2.0 CS-$MoS_2$—Oil.
Figure 16:
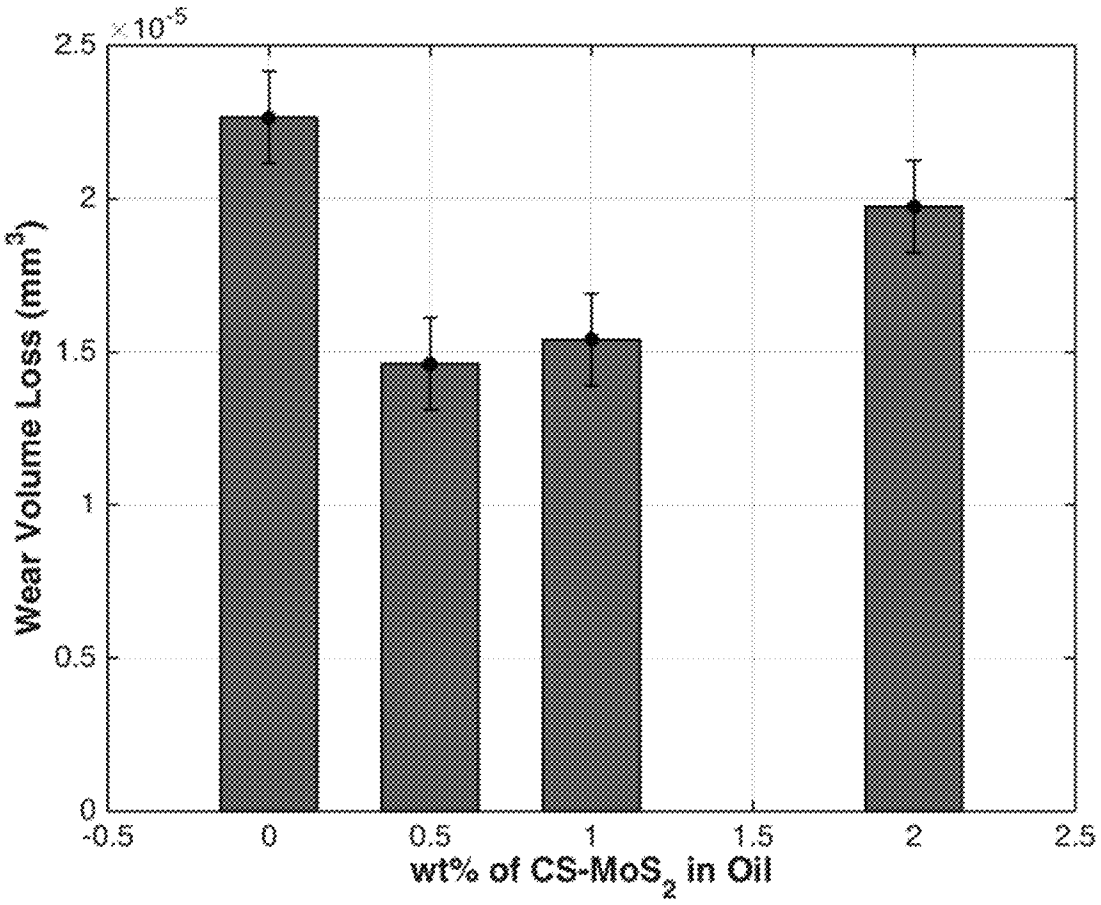
FIG. 16 is a representation of wear volume loss for neat oil, 0.5 CS-$MoS_2$-Oil, 1.0 CS-$MoS_2$—Oil, and 2.0 CS-$MoS_2$—Oil after 1.5 GPa contact pressure tribo-test using a ball-on-disk tribometer.
Figure 17:
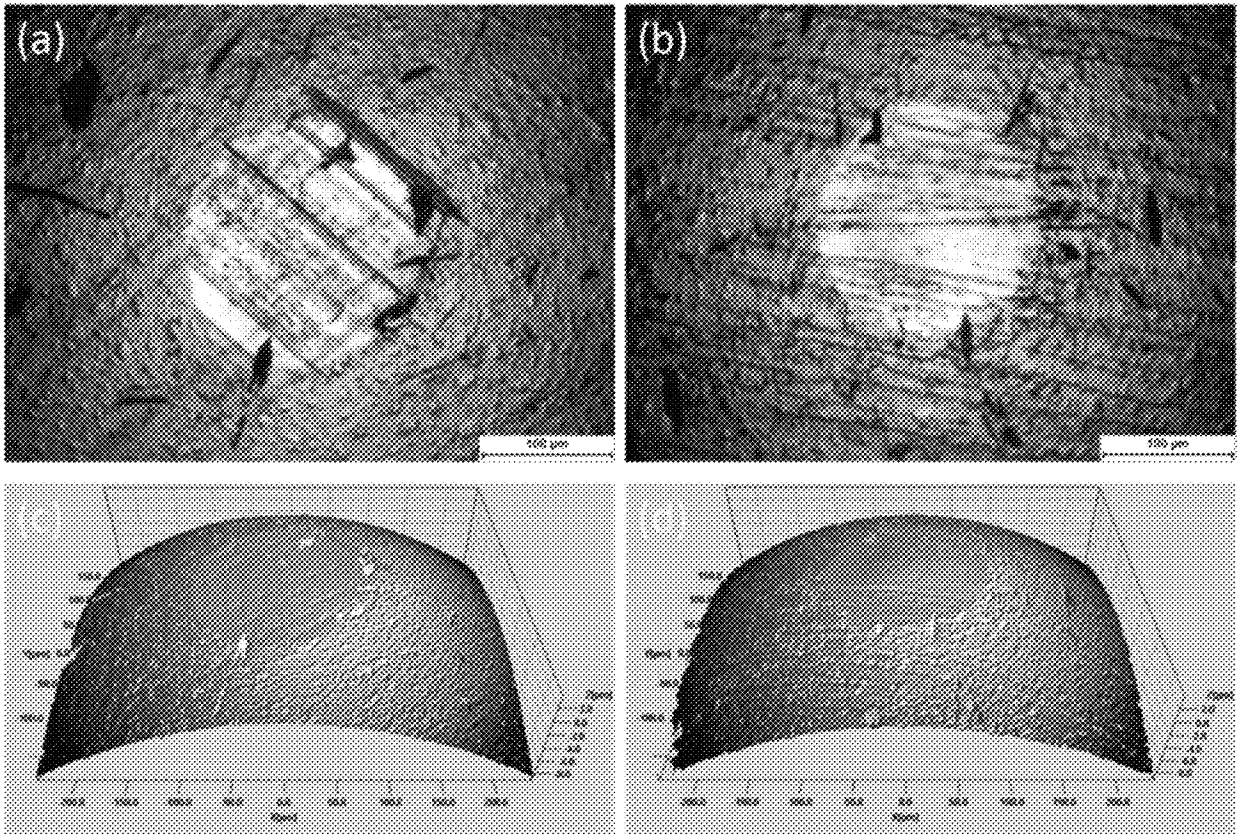
FIG. 17 includes wear scar optical micrographs (images (a) and (b)) and 3d surface scans (images (c) and (d)) of ball specimens after 1.5 GPa contact pressure tribo-tests using a ball-on-disk tribometer for neat oil (images (a) and (c)) and 1.0 CS-$MoS_2$—Oil (images (b) and (d)).

Samples were produced having compositions comprising the carbon sphere-$MoS_2$ particles dispersed in the reference oil at concentrations of about 0.5, 1.0, and 2.0 weight percent, identified herein as 0.5 CS-$MoS_2$—Oil, 1.0 CS-$MoS_2$—Oil and 2.0 CS-$MoS_2$—Oil, respectively (collectively referred to as CS-$MoS_2$ samples). Tribological performance of the samples was studied in the boundary and mixed lubrication regimes using a tribometer under ball-on-disk and cylinder-on-disk configurations. The CS-$MoS_2$ samples evidenced lower coefficients of friction compared to the pure reference oil for all weight percent concentrations. A maximum friction reduction (about 8 to 15%) was achieved during disk rotational speed less than 400 rpm using the ball-on-disk configuration (FIG. 15). Wear volume loss of the tested ball specimens measured after each test using an optical surface profilometer indicated that the addition of carbon sphere-$MoS_2$ particles reduced the wear volume loss by 14 to 35% compared to the reference oil alone after 1.5 GPa contact pressure tribometer tests (FIG. 16). FIG. 17 includes wear scar optical micrographs (images (a) and (b)) and 3d surface scans (images (c) and (d)) of ball specimens after 1.5 GPa contact pressure tribo-tests using a ball-on-disk tribometer for neat oil (images (a) and (c)) and 1.0 CS-$MoS_2$—Oil (images (b) and (d)).

According to a nonlimiting embodiment of the invention, an ultrasound-assisted method may be used to produce carbon particle lubricant additives possessing excellent mechanical and chemical stability. The ultrasound-assisted method may include polymerization of resorcinol and formaldehyde in an aqueous system followed by a heat treatment in an inert or non-oxidizing atmosphere. Nonlimiting examples of inert or non-oxidizing atmospheres include flowing helium, argon, and nitrogen. A nonlimiting example of the heat treatment temperature is in the range of about 500 to about 3000° C. To improve dispersion of the carbon particles, a surfactant, preferably non-ionic, can optionally be included in the lubricant.

The carbon particles produced by the method are preferably ultrasmooth, nearly spherical, and submicrometer in size. For example, the carbon particles may be solid (not hollow) spheres with an average diameter of less than 1000 nanometers, and more preferably having diameters between about 100 to 500 nm. Such carbon particles may result in a significant reduction in friction and wear (10-25%) in the boundary and mixed lubrication regimes. Unlike conventional nanoparticle additives, the morphology and chemical composition of the carbon spheres may be preserved during use.

Another nonlimiting embodiment of this invention includes a lubricant composition comprising spherical ultrasmooth submicrometer carbon particles in a liquid hydrocarbon carrier. Optionally, the carbon particles may be decorated with an inorganic material to further improve the friction reduction and wear reduction of the lubricant.

It should be noted that the concepts described herein are not to be limited to the materials, such as carbon spheres and hybrid materials thereof. Various other forms of spherical ultrasmooth submicrometer particles are possible to be implemented by those of ordinary skill in the art, based on the principles, concepts, and methods described in this disclosure.

While the invention has been described in terms of specific embodiments, it is apparent that other forms could be adopted by one skilled in the art. For example, the composition of the lubricants could differ from that described herein, and materials and processes/methods other than those noted could be used. Therefore, the scope of the invention is to be limited only by the following claims.

The invention claimed is:

1. A lubricant comprising submicrometer spherical particles in a carrier, the submicrometer spherical particles each consisting of an amorphous carbon sphere and an irregular coating on a surface of the amorphous carbon sphere, the irregular coatings each being formed by an inorganic nanolayer with protrusions that protrude from adjacent surfaces of the irregular coatings, the amorphous carbon spheres individually having maximum and minimum diameters that differ by no more than ten nanometers, and having diameters of 100 nanometers to less than one micrometer.

2. The lubricant of claim 1, wherein the submicrometer spherical particles are not hollow.

3. The lubricant of claim 1, further comprising a surfactant.

4. The lubricant of claim 3, wherein the surfactant is a non-ionic surfactant.

5. The lubricant of claim 1, wherein the lubricant does not contain a surfactant.

6. The lubricant of claim 1, wherein the inorganic nanolayer comprises inorganic fullerenes of a material selected from the group consisting of molybdenum disulfide, tungsten disulfide, copper disulfide, and tin disulfide.

7. The lubricant of claim 1, wherein the lubricant has a composition having 0.5 to 5.0 wt. % of the submicrometer spherical particles.

8. The lubricant of claim 1, wherein the carrier is a liquid hydrocarbon carrier.

9. The lubricant of claim 1, wherein the diameters of the amorphous carbon spheres are 100 nanometers to 500 nanometers.

* * * * *